US005695017A

United States Patent [19]

Gessner

[11] Patent Number: 5,695,017

[45] Date of Patent: Dec. 9, 1997

[54] EARTH BORING APPARATUS

[76] Inventor: Richard W. Gessner, 1705 - 11th St., Massillon, Ohio 44646

[21] Appl. No.: 663,931

[22] Filed: Jun. 14, 1996

[51] Int. Cl.[6] ..... E21B 7/02

[52] U.S. Cl. ..... 175/122; 173/29; 173/46; 173/184; 175/162; 175/203

[58] Field of Search ..... 175/122, 162, 175/62, 203; 173/29, 46, 184, 185, 24; 37/403, 404, 468; 299/67

[56] References Cited

U.S. PATENT DOCUMENTS

| | | | |
|---|---|---|---|
| 2,969,844 | 1/1961 | Hamrick | 173/159 X |
| 4,087,010 | 5/1978 | Stormon | 299/67 X |
| 4,360,980 | 11/1982 | Jarvis | 37/404 |
| 4,417,628 | 11/1983 | Gessner | 173/29 |
| 4,998,590 | 3/1991 | Wells | 175/162 |
| 5,507,354 | 4/1996 | Harleman | 175/162 |

*Primary Examiner*—Hoang C. Dang
*Attorney, Agent, or Firm*—Donald R. Fraser

[57] ABSTRACT

An apparatus for boring horizontally extending holes at shallow depths beneath the surface of the earth having a frame detachable connected to the bucket of a backhoe. The frame is rigidly connected to the bucket for movement thereby and includes a coupling and drive unit which is detachably mounted within the frame so that the coupling and drive unit can be reversed to push or pull an auger connected thereto in opposite directions relative to the bucket.

2 Claims, 2 Drawing Sheets

EARTH BORING APPARATUS

BACKGROUND OF THE INVENTION

1. Field of the Invention

This invention generally relates to improvements in earth boring apparatus, and more particular, to an attachment for use with a backhoe in boring shallow depth, substantially horizontal holes through the earth.

2. Description of the Prior Art

As is well known in the installation of utility services, it is frequently necessary or desirable to extend service transmission lines at shallow depths beneath the surface of the earth underneath sidewalks, driveways and the like. Various types of devices have been devised in the past for forming horizontally extending bores through the earth, but most of these prior art devices are complicated, cumbersome to use and expensive as such devices have been designed to be affixed directly to the boom of a vehicular means such as a backhoe.

U.S. Pat. No. 4,417,628 illustrates and describes an earth boring apparatus directly connectable to a conventional backhoe bucket and generally includes a rotatably driven auger, means for driving the auger and means for detachable securing the driving means to the bucket. More specifically, the means for detachable securing the driving means to the bucket includes a frame means which is adapted to be rigidly secured to the bucket.

The frame means includes an upper horizontal plate for contacting the outer curvature of the bucket. A pair of positionable hooks are pivotally mounted along one side of the plate for engaging the cutting edge of the bucket between the teeth. A length of chain is anchored to one corner on the opposed side of the plate. The chain is passed through a tensioning device mounted on the pin attaching the piston rod of the actuating cylinder to the bucket. The free end of the chain is detachably secured to the other corner of the opposed side. By this structural arrangement, the frame means may be quickly and securely attached to the backhoe bucket.

A surface engaging skid, affixed to the lower end of the frame means, supports the frame, driving means and auger from the bottom surface of a hole provided for producing the subsurface, horizontally extending bore in the earth.

While the earth boring apparatus of U.S. Pat. No. 4,417,628 functions reasonably satisfactory, it has been found that overall structure was prone to slide forward and backward in the manner of the conventional porch glider, for example. Such movement tended to impose certain undesirable forces on the auger mechanism.

SUMMARY OF THE INVENTION

By certain structural modifications and changes in the frame structure and the interconnection with the associated bucket, certain unexpected operational results were manifested.

The objectives of the invention are typically realized by a boring apparatus having a rotatably driven auger for use in combination with a bucket pivotally attached to a moveable boom of a vehicular means comprising an open upstanding frame including a pair of spaced upright members; a mounting plate extending between the pair of upright members of the frame; a power driven auger affixed to the mounting plate; a chain receiving bracket; a chain interconnecting the bucket and the upright members of the frame; and means mounting the bracket to the bucket.

BRIEF DESCRIPTION OF THE DRAWINGS

The above as well as other objects of the invention will become readily apparent to one skilled in the art from reading the following detailed description of the preferred embodiments of the invention when considered in the light of the accompanying drawings in which.

DETAILED DESCRIPTION OF THE PREFERRED EMBODIMENTS

Figure 1:
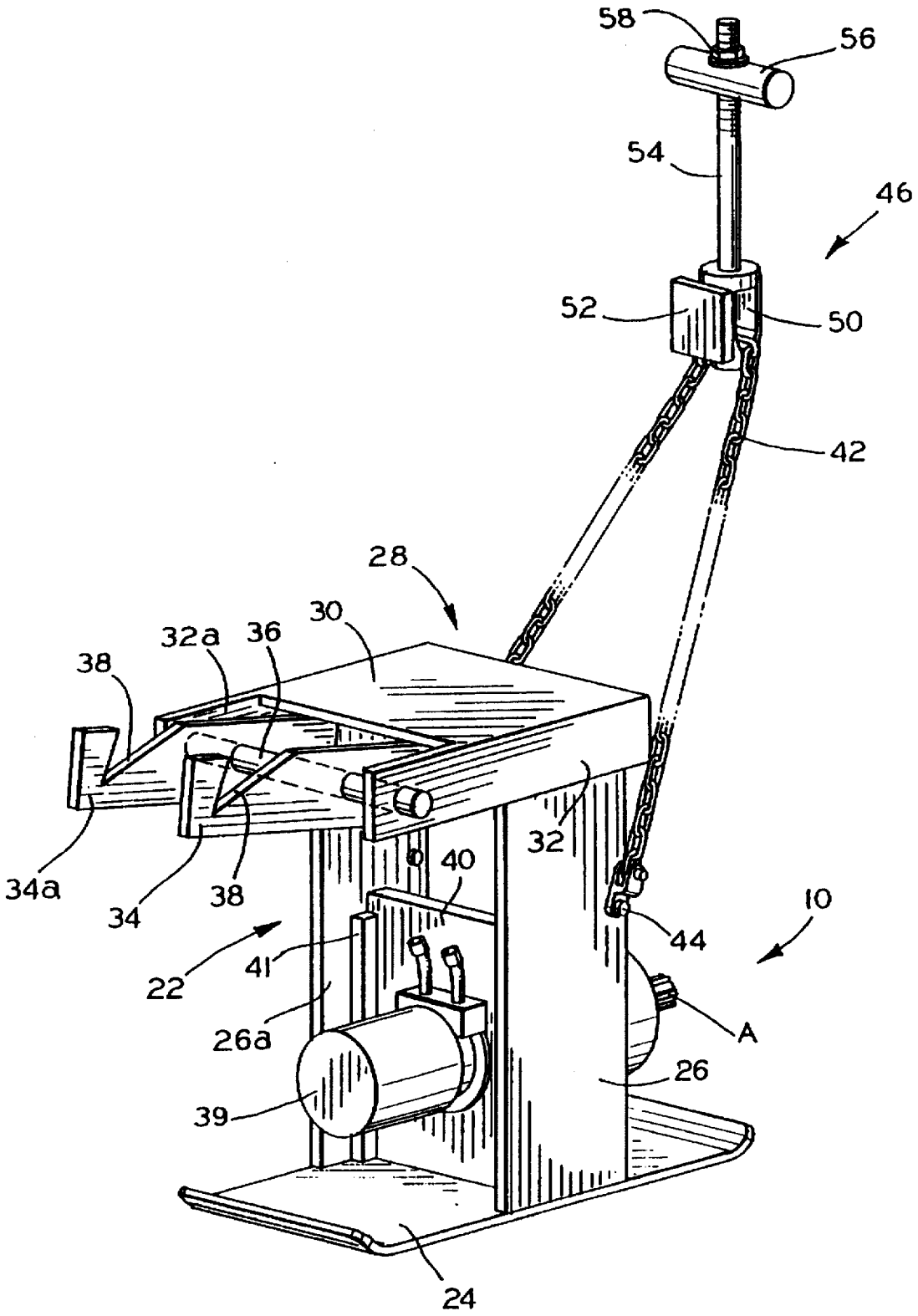
FIG. 1 is a perspective view illustrating an earth boring attachment attached to the bucket of a backhoe in accordance with the present invention.

Referring now to the drawings wherein like reference numerals designate similar parts throughout, there is illustrated an earth boring apparatus 10 adapted to be detachably secured to a bucket 12 of a conventional backhoe (not shown) or like vehicular means, as it would appear in actual use. As illustrated therein, the earth boring attachment 10 is detachably secured to the bucket 12 which is pivotally mounted on the end of a boom 14. The attitude and reach of the bucket 12 is adjusted by an actuating cylinder 16. Accordingly, the position of the earth boring apparatus 10 is controlled by movement of the bucket 12 and is primarily employed in boring horizontally extending holes such as hole 18 at a desired shallow depth beneath a driveway 20 or the like, for placing cables and etc. below the surface of the earth.

Referring particularly to FIG. 1, the earth boring apparatus 10 generally includes a vertically disposed, frame means 22 (preferably a weldment structure) having a lower surface engaging skid 24, a pair of rectangularly shaped upright members 26 and **26*a* affixed to the mid section of the skid 24 and bucket attaching means 28 affixed to the upper ends of the members 26 and 26*a***.

As illustrated, the bucket attaching means 28 includes a horizontally disposed, rectangular plate 30 having depending side flanges 32 and **32*a* extending along the opposite sides, respectively. The plate 30 is affixed to the upper ends of the upright members 26 and 26*a***.

Two spaced hooks 34 and **34*a* are pivotally mounted on a transversely extending rod 36. The rod 36 is mounted in brackets projecting beyond the flanges 32 and 32*a*, respectively. Each hook 34 and 34*a* is slidable along the rod 36 and each is provided with a V-shaped notch 38 for engagement with the cutting edge of the bucket 12 between the teeth 12*a* (see FIG. 2**).

A length of chain 42 is provided at the opposite side of the upright members 26 and **26*a* for attaching the frame means to the bucket 12. More particularly, one end of the chain is anchored to the upright member 26 at 44. The other end of the chain 42 is connected to the other upright member 26*a* at 44*a*. A chain receiving bracket assembly 46 receives the midpoint of the chain 42 and is connected to the bucket on the side opposite the teeth 12*a*. The chain receiving bracket assembly 46 includes an eye bracket 50 provided with a pad 52 dependingly mounted on an elongate shank 54 adapted to be slidingly received within a hole formed to extend through a rod 56. The shank 54 is provided with externally formed threads which typically extend for a portion of the length of the shank. The shank 54 may be adjusted relative to the rod 56 by an internally threaded nut and washer assembly 58**.

The rod 56 is adapted to be received by a bracket 60 attached to the bucket 12 and provided with a pair of spaced apart outwardly extending support fingers.

A motor, such as a hydraulic motor 39, or the like, is detachably mounted at the bottom portion of the frame means 22 adjacent the skid 24 and is connected to a source of fluid power provided by the backhoe tractor (not shown) by the way of fittings and hoses, which typically extend along the boom 14. The motor 39 is secured to a mounting plate 40. The opposite vertically marginal edges of the mounting plate 40 are telescopically received in opposed vertically disposed guideways each defined by pairs of spaced upright bar members 41 affixed to the inner facing surfaces of the upright plates 26 and 26*a* adjacent the skid 24. It will be noted that mounting plate 40 may be pushed or pulled by the frame 22 and can be removed from the guideways and reversed for producing the bore hole 18 in either axial direction.

Figure 2:
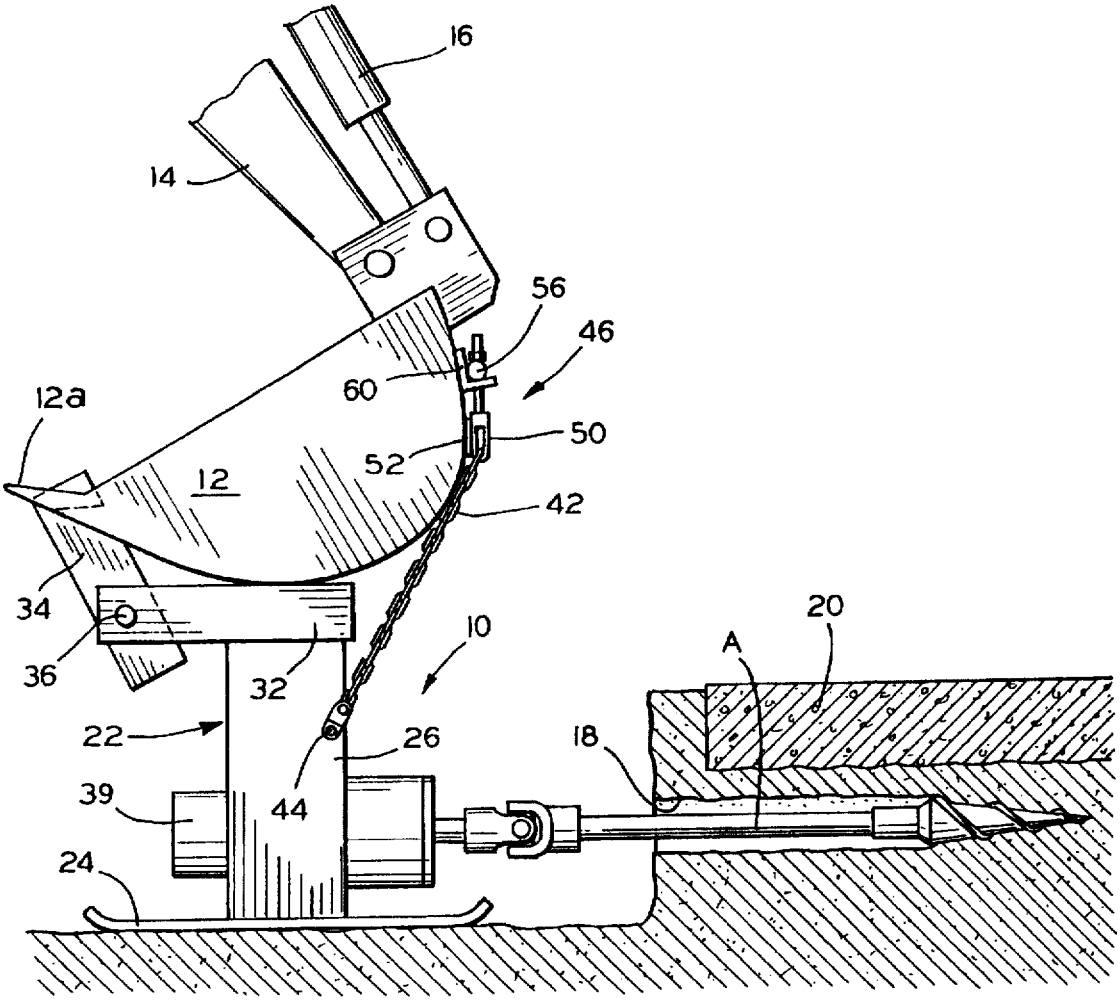
FIG. 2 is a side elevational view of illustrating the frame means of FIG. 1 attached to the bucket of a backhoe.
Figure 3:
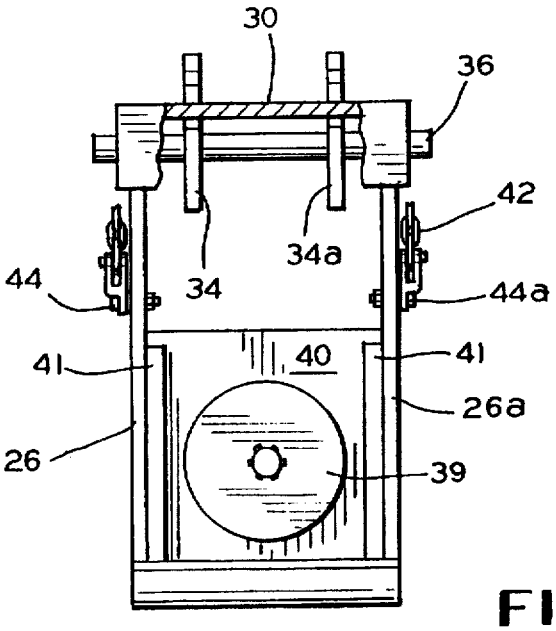
FIG. 3 is a partially cut-away front view of the apparatus illustrated in FIG. 2.

As best illustrated in FIG. 2, an earth boring auger A is coupled to the driven output shaft of the motor 39 by a direct drive coupling mounted on the face opposite the face on which the motor 39 is mounted.

In attaching the apparatus 10 to the bucket 12, the curved portion of the bucket is first set on the plate 30. Next, the hooks 34 and 34*a* are moved to a position between the bucket teeth 12*a* to engage the cutting edge of the bucket. The rod 56 is then attached to the bracket 60 where it is free to pivotally move. The chain 42 is then passed through the eye bracket 50 and pulled taut until the curved portion of the bucket snugly engages the plate 30 as well as the pad 52 of the eye bracket 50. The free end of the chain is secured to the upright member 2. The nut 58 is then tightened, drawing up the eye bolt 50 and tensioning the chain 42 until the apparatus 10 is rigidly attached to the bucket.

One of the advantages of the afore-described coupling structure mounting is that axial thrust loads are accommodated by the coupling and transmitted directly to the frame means without transmitting such loads to the motor. Accordingly, the useful life of the earth boring apparatus is substantially increased before repairs or replacement of the components may be repaired.

In use, the earth boring apparatus is capable of being readily positioned in a relatively short, shallow trench such as illustrated in FIG. 2, adjacent the driveway 20 under which the bore hole 18 is to be formed. In operation, the rotatably driven earth auger A is moved forwardly or rearwardly, as the case may be, by manipulation of boom 14 of the bucket operating mechanism.

When the auger A is fully extended into the bore hole 18, it may be uncoupled from the coupling output shaft and an additional length of shaft such as the section may be added. Then, the boring cycle is continued until the desired length of the bore hole 18 is achieved.

In accordance with the provisions of the patent statutes, the principles and mode of use of the invention has been explained and what is considered to represent its preferred embodiment has been illustrated and described. It should, however, be understood that the invention may be practiced otherwise and as specifically illustrated and described without departing from its spirit and scope.

What is claimed is:

1. A boring apparatus having rotatably driven auger for use in combination with a bucket pivotally attached to a movable boom of a vehicular means, comprising a) an open upstanding frame including a pair of spaced upright members, a ground engaging skid fixedly secured to the lower ends of the upright members, and hook means pivotally mounted at the upper ends of the upright members engageable with the bucket;

b) a mounting plate extending between the pair of upright members of said frame;

c) a power driven auger affixed to said mounting plate;

d) a chain receiving bracket;

e) a chain interconnecting said bracket and the upright members of said frame; and f) means mounting said bracket to the bucket.

2. As defined in claim 1 wherein said means mounting said bracket to the bucket includes a threaded shank for tightening said chain to said chain receiving bracket.

* * * * *